US007093324B2

(12) United States Patent
Udy

(10) Patent No.: US 7,093,324 B2
(45) Date of Patent: Aug. 22, 2006

(54) APPARATUS AND METHOD FOR FACILITATING THE LIFTING AND CARRYING OF OBJECTS WITHOUT HANDLES

(75) Inventor: David B. Udy, Salt Lake City, UT (US)

(73) Assignee: HandiSolutions, Inc., Salt Lake City, UT (US)

( * ) Notice: Subject to any disclaimer, the term of this patent is extended or adjusted under 35 U.S.C. 154(b) by 0 days.

(21) Appl. No.: 11/027,356

(22) Filed: Dec. 29, 2004

(65) Prior Publication Data

US 2006/0085950 A1 Apr. 27, 2006

(51) Int. Cl.
*A45C 3/00* (2006.01)

(52) U.S. Cl. ..... 16/428; 16/444

(58) Field of Classification Search ..... 16/428, 16/425, 426, 435, 444, 442; 294/149, 150, 294/153, 154, 157, 165; 248/95; 224/218, 224/901, 901.2; 229/117.26; 383/6, 13; 482/44

See application file for complete search history.

(56) References Cited

U.S. PATENT DOCUMENTS

| | | | | | |
|---|---|---|---|---|---|
| 3,031,359 | A * | 4/1962 | Blank et al. | ..... | 229/117.26 |
| 3,301,586 | A | 1/1967 | Lisiecki | | |
| 3,820,837 | A | 6/1974 | Fredrickson | | |
| 3,912,140 | A | 10/1975 | Franges | | |
| D248,821 | S * | 8/1978 | Poe | ..... | D8/107 |
| 4,109,952 | A | 8/1978 | Monzain | | |
| 4,176,423 | A | 12/1979 | Wigemark | | |
| 4,488,748 | A * | 12/1984 | Burkes | ..... | 294/147 |
| 4,678,217 | A | 7/1987 | Viola | | |
| 4,707,011 | A | 11/1987 | McKim | | |
| 4,791,702 | A * | 12/1988 | McVey | ..... | 16/428 |
| 4,854,138 | A * | 8/1989 | Charland | ..... | 70/16 |
| 4,856,689 | A * | 8/1989 | Shore | ..... | 224/218 |
| 4,866,813 | A | 9/1989 | Dupont | | |
| 5,419,009 | A | 5/1995 | Assis | | |
| 5,586,628 | A | 12/1996 | Wang | | |
| 5,772,109 | A | 6/1998 | Phipps | | |
| 5,791,014 | A | 8/1998 | Wong | | |
| 5,794,999 | A | 8/1998 | Corsaro | | |
| 5,871,242 | A | 2/1999 | Whitney | | |
| 6,014,850 | A | 1/2000 | Lemire | | |
| 6,065,788 | A | 5/2000 | Brady | | |
| 6,217,091 | B1 | 4/2001 | Whitney | | |
| 6,375,237 | B1 | 4/2002 | Koenig | | |
| 6,422,620 | B1 | 7/2002 | Jordening | | |
| 2003/0111856 | A1 * | 6/2003 | Hewett | ..... | 294/150 |

* cited by examiner

*Primary Examiner*—Robert J. Sandy
*Assistant Examiner*—Mark T. Vogelbacker
(74) *Attorney, Agent, or Firm*—Starkweather & Associates; Mark W. Starkweather; Jason P. Webb

(57) ABSTRACT

There is a gripping section with first and second open ends, a ductile member, such as a strap, forming first and second hoops extending from the first and second open ends. The hoops and wrap and tighten around the object. Ends of the ductile member protrude through a hole in the handle. A fastener receives the ends of the ductile member to allow a user to tighten the hoops. There may be a plurality of ductile members. There may be a slot in the gripping section.

20 Claims, 8 Drawing Sheets

APPARATUS AND METHOD FOR FACILITATING THE LIFTING AND CARRYING OF OBJECTS WITHOUT HANDLES

This invention claims priority, under 35 U.S.C. § 120, to the U.S. patent application Ser. No. 10/972,041 to David B. Udy filed on Oct. 22, 2004.

BACKGROUND OF THE INVENTION

1. Field of the Invention

This invention relates to handles and more particularly relates to handles with retractable straps to secure to objects without handles.

2. Background Art

For convenience sake, handles have been added to all types of movable objects, such as luggage, shopping bags, boxes, etc. These handles have proven to be extremely helpful and advantageous. Unfortunately, there are many products that do not include handles to assist in transportation. Handles have not been attached to these products for the mere fact that the product may be unattractive with handles, the product may not function as intended with handles attached, or it simply costs too much to attach handles thereto.

Additionally, some products with handles may still be difficult to carry due to the handle configuration. For example, boxes may be configured with handles that have been cut into the sides of the box, into which a user inserts the hands. These handles suffer from at least three distinct disadvantages. First, it requires both hands inserted into the handles to carry the box. In many situations, the user is already holding an object and it is therefore impossible to hold the object and carry the box at the same time. Second, the box may be loaded to a point that inserting ones hands into the handles is impeded by objects inside the box. Third, the handles tend to tear due to their placement as most of the weight bears on the bottom of the box, rather than on the sides.

From the foregoing discussion, it should be apparent that a need exists for an apparatus and method for facilitating the lifting and movement of object that do not have handles already attached thereto.

SUMMARY OF THE INVENTION

The present invention has been developed in response to the present state of the art, and in particular, in response to the problems and needs in the art that have not yet been fully solved by currently available handles that can be attached to movable objects. Accordingly, the present invention has been developed to provide an apparatus and method for moving objects that do not have handles that overcome many or all of the above-discussed shortcomings in the art.

The apparatus, in one embodiment, is configured to facilitate movement of handless objects, such as a box. The apparatus comprises a gripping section having a first open end and a second open end, a ductile member, such as rope or a strap, forming a first hoop extending from the first open end and a second hoop extending from the second open end and configured to wrap around the object, and wherein ends of the ductile member protrude through a hole in the handle, and a fastener configured to receive the ends of the ductile member and to allow a user to tighten the hoops around the object and to maintain a tight grip around the object.

In another embodiment, the handle includes spacers to position the handle over the object to be carried such that a user's hand does not contact the object. An additional ductile member may be attached to the spacers and used to longitudinally wrap around the object. In still another embodiment, the ductile member is coated with a gripping layer, such as rubber or silicone to provide additional grip on the object.

In another embodiment, a plurality of ductile members extend from the gripping section and an attachment means attaches to distal ends of the ductile members to secure the object to the handle to facilitate movement thereof. In one embodiment, the ductile members connect at a central location within the gripping section. In another embodiment, the gripping section includes a slot on a side, which extends the length of the gripping section and configured such that a user can remove the ductile members from the gripping section to open a box or bag being held by the handle.

In other embodiments, the attachment means may be a tacky material, which sticks to the object. However, the attachment means of one ductile member may also be attached to a corresponding attachment means of a different ductile member so that the attachment means does not have to attach to the object; rather, the ductile members would wrap around the object.

While the handle is not in use, a removable cover can be applied to the tacky material to prevent it from inadvertently sticking to the wrong object, the gripping section, or ductile members. Additionally, the gripping section may be hollow to store the ductile members when the handle is not in use.

A method is also provided for using a handle to lift an object without handles. The method in the disclosed embodiments substantially includes the steps necessary to carry out the functions presented above with respect to the operation of the described apparatus. In one embodiment, the method includes the steps of providing a gripping section with a first open end, or first aperture, and a second open end, or second aperture, providing a ductile member through the gripping section, forming, from the ductile member, a first hoop extending from the first open end and a second hoop extending from the second open end, wrapping the first and second hoops around the object, providing a hole in the handle, through which ends of the ductile member protrude, providing a fastener to receive the ends of the ductile member and to maintain a tight grip on the ends of the ductile member, and pulling the ends of the ductile member to tighten the first and second hoops and around the object to maintain a tight grip around the object.

In another embodiment, the method includes the step of providing spacers, which protrude from a bottom side of the handle to contact a top side of the object, such that a user can grip the gripping section without contacting the object when the first and second hoops and are tightened around the object. In still another embodiment, the method provides notches in the handle to pinch the ductile member upon lifting of the object to prevent the ductile member from movement and to provide additional stability around the object.

In yet another embodiment, the method comprises the steps of providing a gripping section, providing a plurality of ductile members protruding from the gripping section, providing attachment means to the ductile members to attach to the object and attaching the attachment means to the object to enable a user to move the object using the handle.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
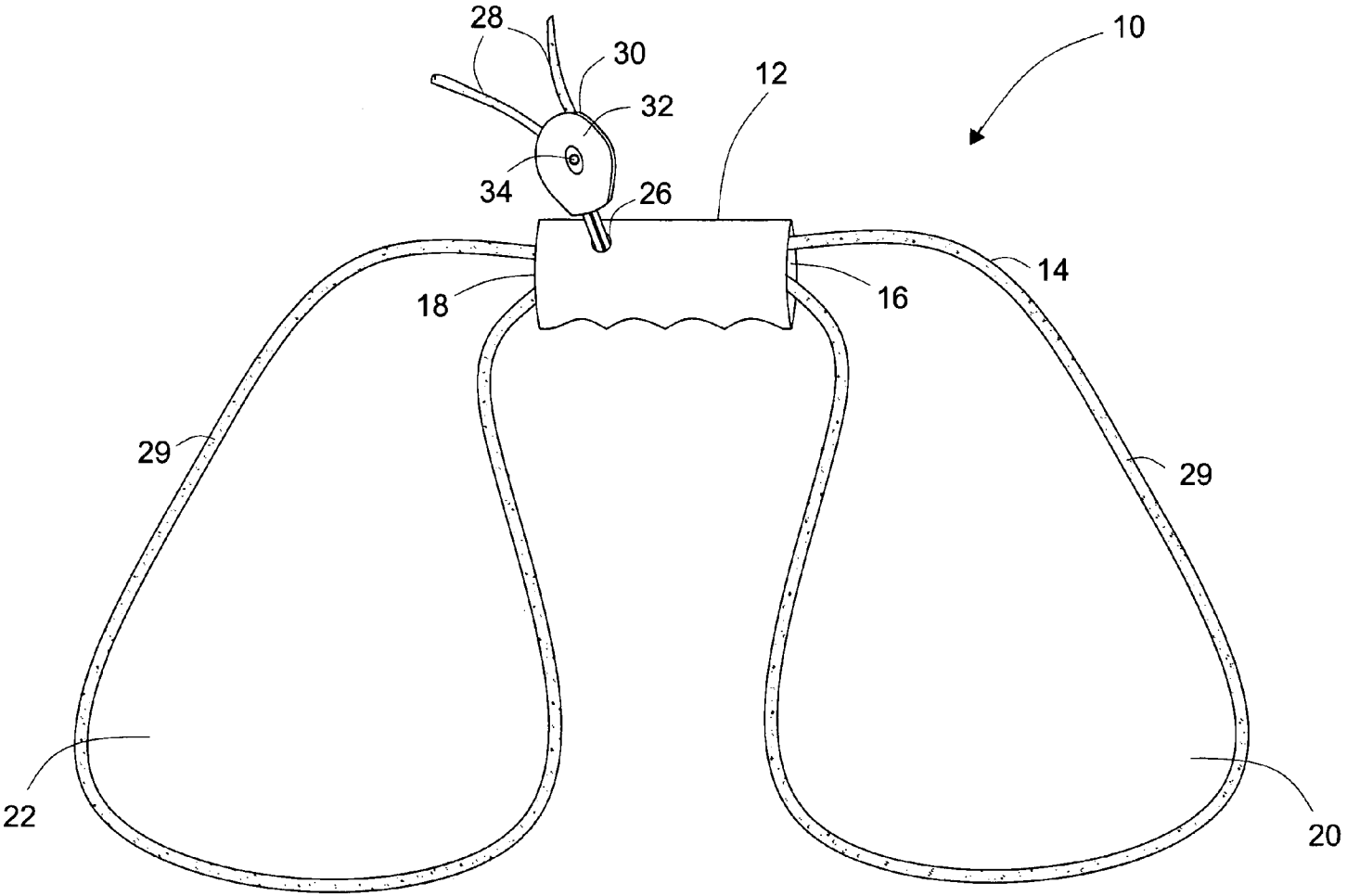
FIG. 1 illustrates a handle according to one embodiment of the present invention.
Figure 2:
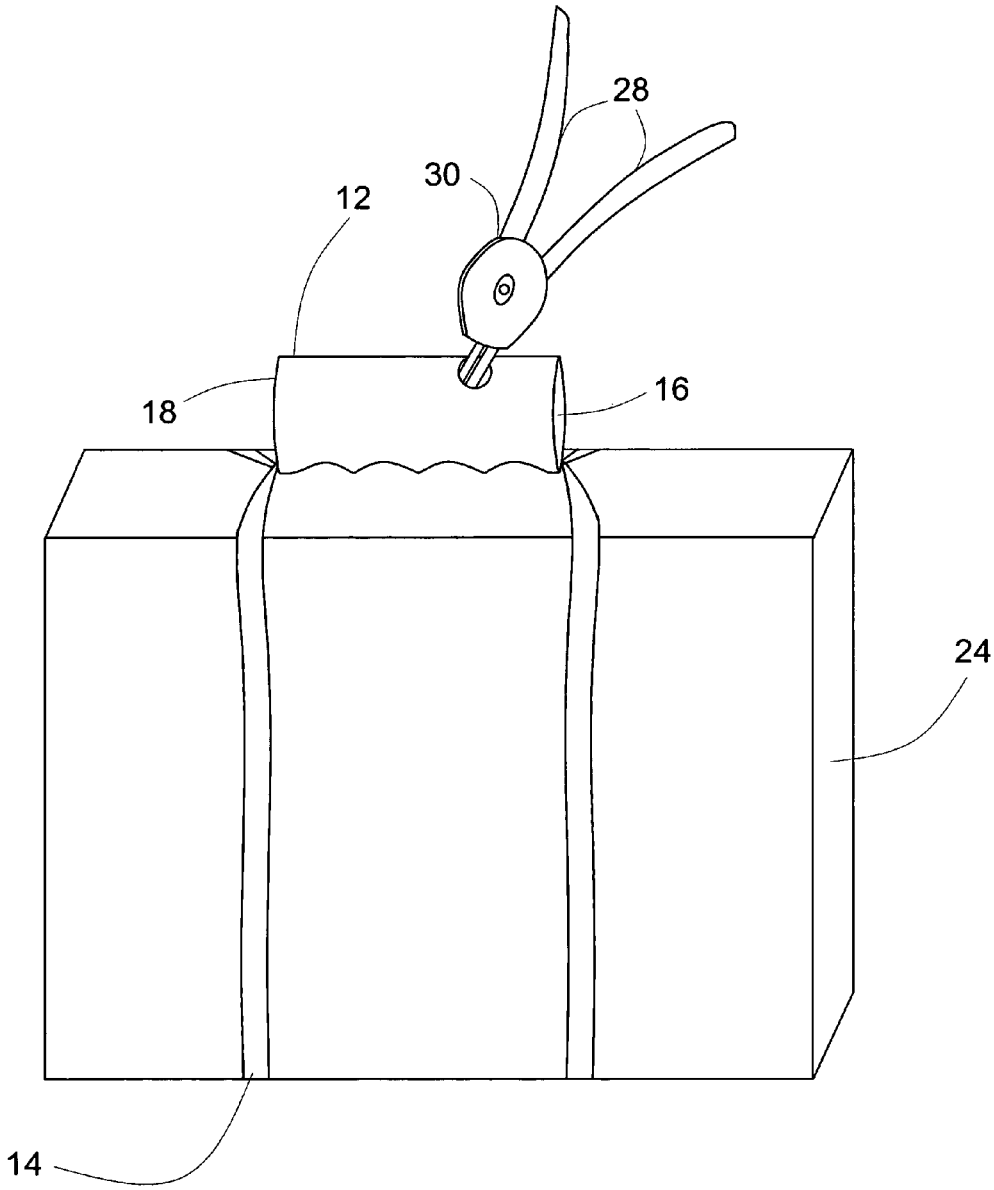
FIG. 2 illustrates a handle attached to an object according to one embodiment of the present invention.

FIGS. 1 and 2 illustrate a handle (10) and method of use according to one embodiment of the present invention. The handle (10) includes a gripping section (12) and a ductile member (14) extending from the gripping section (12). In one embodiment, the gripping section (12) includes a first open end, or first aperture, (16) and a second open end, or second aperture, (18) through which the ductile member (14) extends. The ductile member (14) forms a first hoop (20) extending from the first open end (16) and a second hoop (22) extending from the second open end (18). The first and second hoops (20) and (22) are configured to wrap around an object (24). In another embodiment, the handle (10) includes a hole (26) through which ends of the ductile member (28) protrude. A fastener (30) receives the ends of the ductile member (28) to allow a user to tighten the first and second hoops (20) and (22) around the object (24) to maintain a tight grip around the object (24).

In the illustrated embodiment, the handle (10) is hollow to receive and store the first and second hoops (20) and (22) when the handle (10) is not in use. To use the handle (10), the user simply removes the hoops (20) and (22) from within the hollow handle (10) and wraps them around the object (24). The hoops (20) and (22) may also be wrapped around the handle (10) when not in use.

The handle (10) may comprise any kind of material, such as plastic, fabric, cardboard, wood, composite, metal, etc. It is noted however, that the stronger the material, the more weight the handle (10) can be used for. It is further noted that the handle (10) is generally intended to be held by one hand. Accordingly, the gripping section (12) has a length of between about 4–10 inches. Naturally, smaller and larger sized gripping sections (12) may be adapted for different purposes. For example, a larger sized gripping section may be adapted as a double handle for use by two people.

In one embodiment, the first and second open ends (16) and (18) comprise notches, or grooves, (not shown) located at a bottom side of the gripping section (12), configured to receive and pinch the ductile member (14) upon lifting of the object (24) to prevent the ductile member (14) from movement and to provide additional stability around the object (24).

The ductile member (14) is any type of flexible, bendable, or pliable material, such as rope, string, straps, cords, ribbons, etc capable of supporting the weight of the desired object (24). In one embodiment, the ductile member (14) is a single piece of material, such as a single cord of fixed length. For simplification purposes, the ductile member (14) only includes two ends (28) to facilitate tightening of the first and second hoops (20) and (22) around the object (24). It is recognized, however, that the ductile member (14) may exist as a plurality of pieces attached together. For example, each hoop (20) and (22) may exist individually, each being an individual ductile member (14), thus the handle (10) has four loose ends (not shown), which loose ends may be configured to tighten individually, or as a unit.

To improve grip on the object (24), according to one embodiment, the ductile member (14), specifically the first and second hoops (20) and (22), may be coated with a gripping type material (29), such as rubber or silicon. TOOL DIP, DIPIT, SILASTIC and PLASTI-DIP are marks used on common rubberized or plasticized non-slip coatings that can be used as the gripping type material (29).

The fastener (30) may be any type of fastener (30) well known in the art, including the typical spring-loaded button types. In a preferred embodiment, the fastener (30) is a clamping roller (34) type, similar to the fastener (30) disclosed in U.S. Pat. No. 3,564,670 to Bengtsson, which is incorporated herein by reference. The fastener (30) of the illustrated embodiment comprises a casing (32) configured to receive the ends of the ductile member (28) and a clamping roller (34) configured to move within the casing (32) between the ends of the ductile member (28). Movement of the clamping roller (34) within the casing (32) locks the ends of the ductile member (28) in a fixed position.

Figure 3:
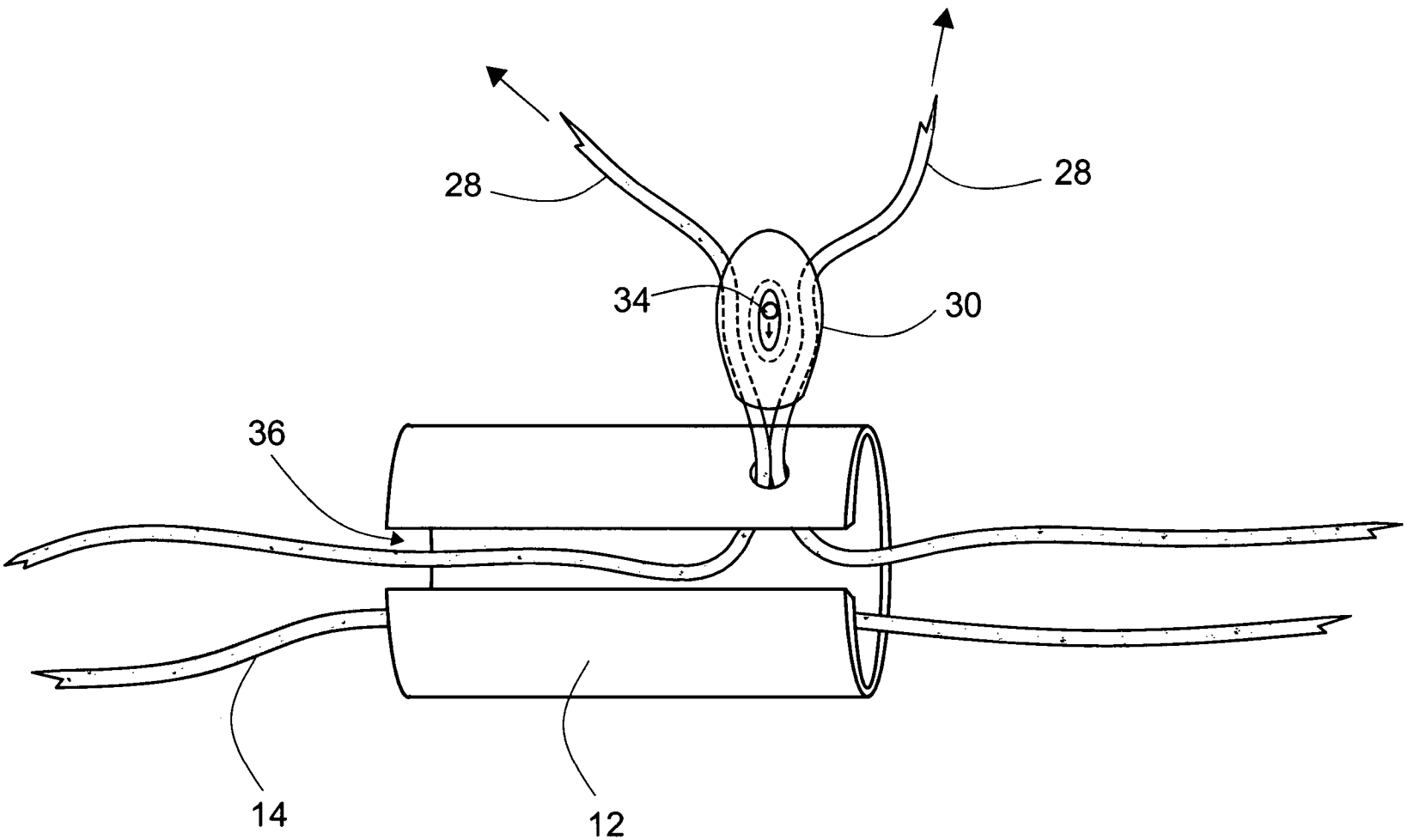
FIG. 3 illustrates a gripping section with a slot for holding a ductile member according to one embodiment of the present invention.

FIG. 3 illustrates a handle (10) (see FIG. 1) with a slot (36) extending from the first open end (16) (see FIG. 1) to the second open end (18) (see FIG. 1). Advantageously, the slot (36) allows the user to remove the ductile member (14) from the gripping section (12) to open a box or bag being held by the handle (10) without completely removing the first and second hoops (20) (see FIG. 1) and (22) (see FIG. 1) from the object (24).

Also illustrated, the effective length of the ductile members (14) may be shortened, thereby tightening the hoops (20) and (22), by pulling the ends of the ductile members (28) in the direction of the arrows. When desired, the clamping roller (34) may be moved in the direction of the arrow, thereby clamping the ductile member (14).

Figure 4:
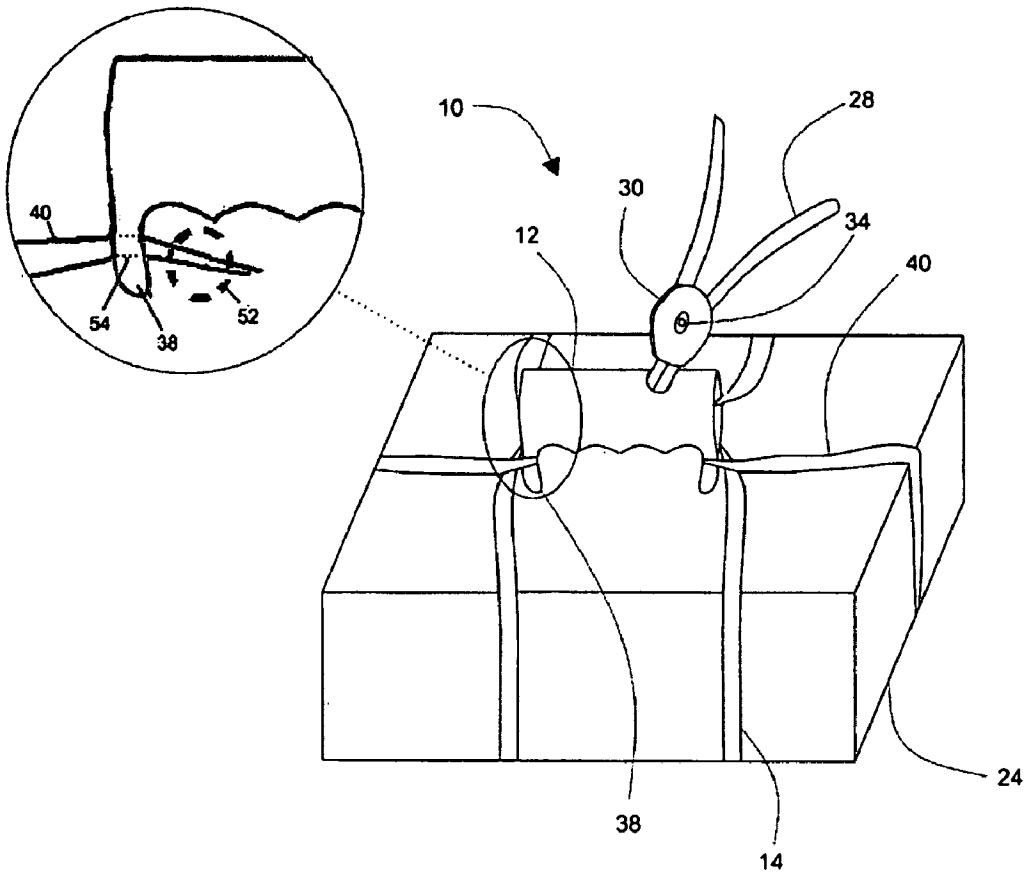
FIG. 4 illustrates a handle configured with spacers to prevent a user's hand from contacting an object according to one embodiment of the present invention.
Figure 5:
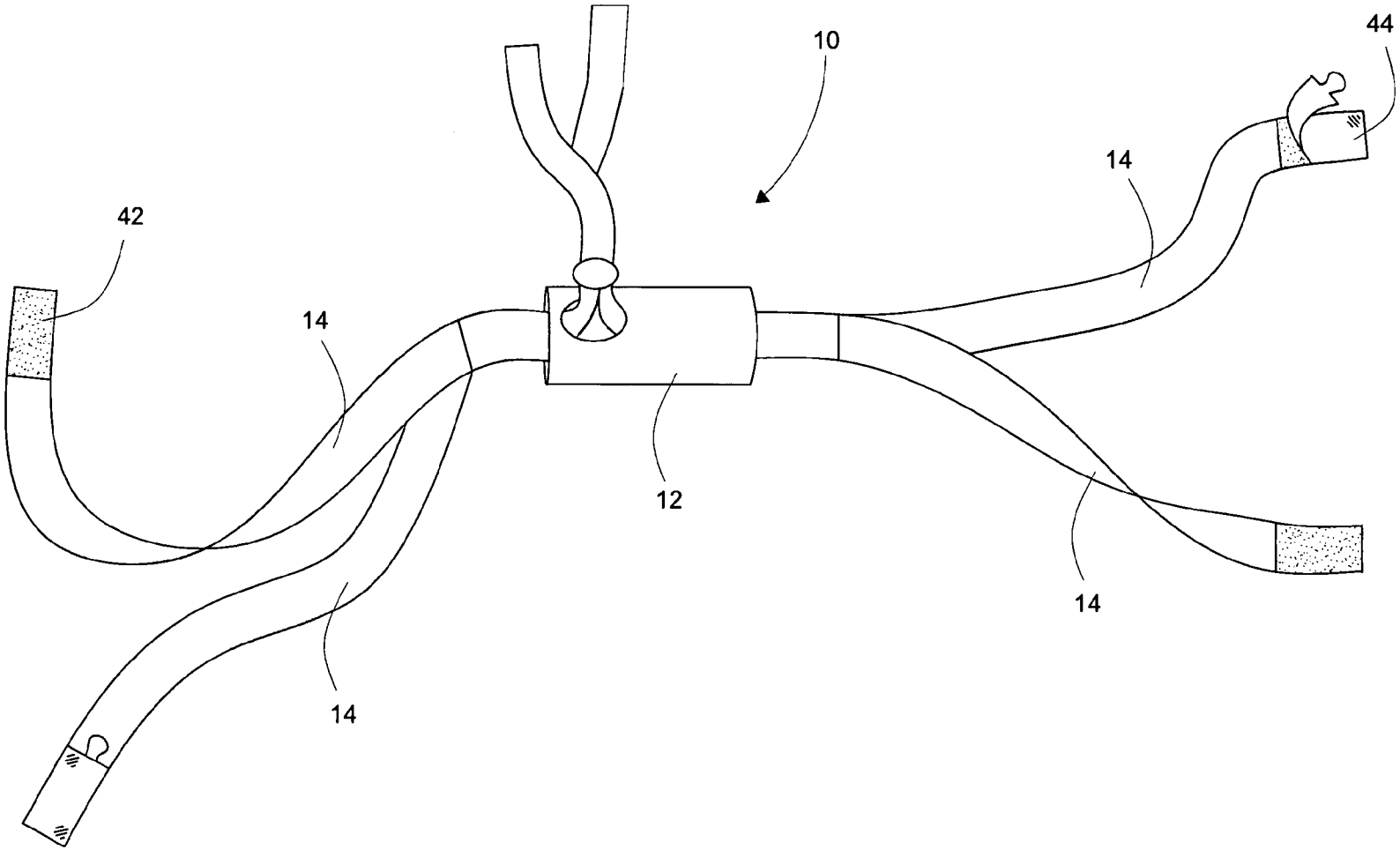
FIG. 5 illustrates a handle according to one embodiment of the present invention.
Figure 6A:
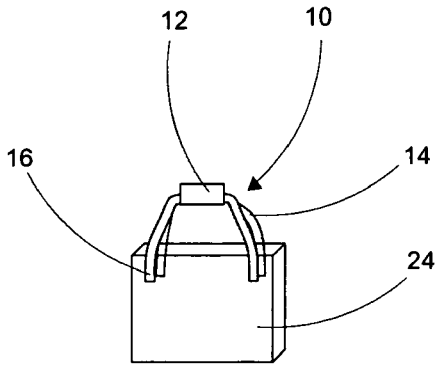
FIGS. 6A–6E illustrate general configurations for attaching the handle according to certain embodiments of the present invention.
Figure 6B:
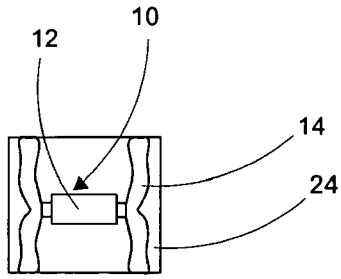
Figure 6C:
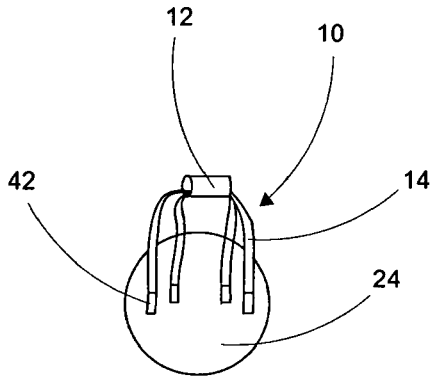
Figure 6D:
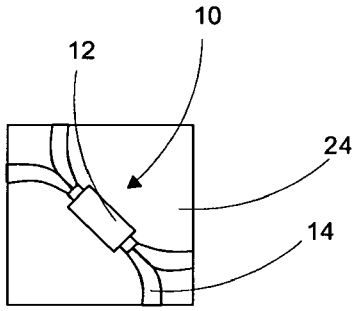
Figure 6E:
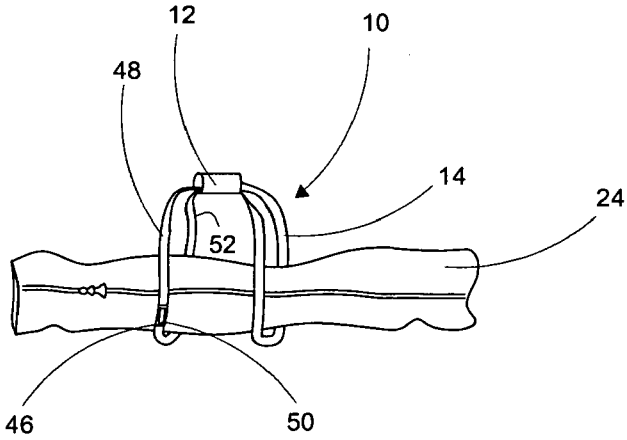

FIG. 4 illustrates another embodiment of a handle (10) attached to an object (24). The handle (10) includes spacers (38) that extend from a bottom side of the gripping section (12) to contact the object (24). The spacers (38) extend sufficiently far to provide a space between the gripping section (12) and a top side of the object (24). The spacers (38) allow the user to grasp the gripping section (12) without the inconvenience, or discomfort, of having to squeeze the fingers and knuckles between the bottom side of the gripping section (12), and the top side of the object (24).

For elongated objects (24), in one embodiment, an additional ductile member (40) may be wrapped around the object (24) longitudinally, with respect to the handle (10), and attached to a hole (54) in the spacers (38). The additional ductile member (40) includes an attachment means (52) at each end of the additional ductile member (40) for attaching to the hole of each spacer (38). In another embodiment, a second fastener (not shown) may be used to receive a portion of the additional ductile member (40) to tighten the additional ductile member (40) around the object (24). The second fastener can be any type of fastener well known in the art, or similar to the fastener (30) described above.

In operation, for storage, the user simply pushes the ductile member (14) into the open ends (16) and (18) of the gripping section (12). The ductile member (14) may also be wrapped around the gripping section (12). For use, the user simply pulls the ductile member (14) from the gripping section (12), and places the object (24) within the first and second hoops (20) (see FIG. 1) and (22) (see FIG. 1). The first and second hoops (20) and (22) should be positioned at least as far apart as the length of the gripping section (12).

Holding the gripping section (12) against the object (24), the user pulls the ends of the ductile member (28) to tighten the first and second hoops (20) and (22) around the object (24). Ultimately, the user pushes the fastener (30) towards the gripping section (12) to take up slack in the ends of the ductile member (28) and pushes the clamping roller (34) toward the gripping section (12) to pinch the ends of the ductile member (28) against the casing (32) (see FIGS. 1 and 3). As the user lifts the object (24), the fastener (30) tightens and notches (not shown) pinch the ductile member (14).

Referring now specifically to FIGS. 5–8, the handle (10) may be configured to comprise a plurality of ductile members (14) extending from the gripping section (12), and an attachment means (42) attached to distal ends of the ductile members (14). The attachment means (42) are configured to secure the object (24) to the handle (10) to facilitate movement thereof. The attachment means (42) may be any type of material capable of attaching to the object (24), such as the box. For example, hook and loop, and tape may be used as the attachment means (42). One skilled in the art will recognize that there are numerous other types of devices for attaching the handle (10) to the object (24). In a preferred embodiment, the attachment means (42) is a tacky material, which sticks to the object (24). Removable covers (44) may be used to prevent the tacky attachment means (42) from inadvertently attaching to the wrong object, the ductile members (14), or the gripping section (12).

In one embodiment, the ductile members (14) connect at a central location within the gripping section (12) to ensure that the object (24) connected to the handle is maintained at a level position.

FIGS. 6A–6E illustrate general configurations for attaching the handle (10) to objects (24). As illustrated, the attachment means (42) (see FIG. 6C) attaches to sides of the objects (24). However, specifically in FIG. 6C, it is also envisioned that the attachment means (42) may be configured to connect directly to another attachment means (42) to create hoops for holding the object (24). More specifically, for explanation purposes, a first attachment means (46) of a first ductile member (48) may be attached to a corresponding second attachment means (50) of a second ductile member (52) so that the attachment means (42) does not have to attach directly to the object (24); rather, the ductile members (48) and (52) wrap around the object (24). Also, the ductile members (48) and (52) may wrap once around the object (24), may wrap a plurality of times around the object (24) or may wrap once or a plurality of times around a portion of the object (24). Additionally, as in FIG. 6E, there may be only one ductile member (48) which may only have one attachment means (46).

Figure 7:
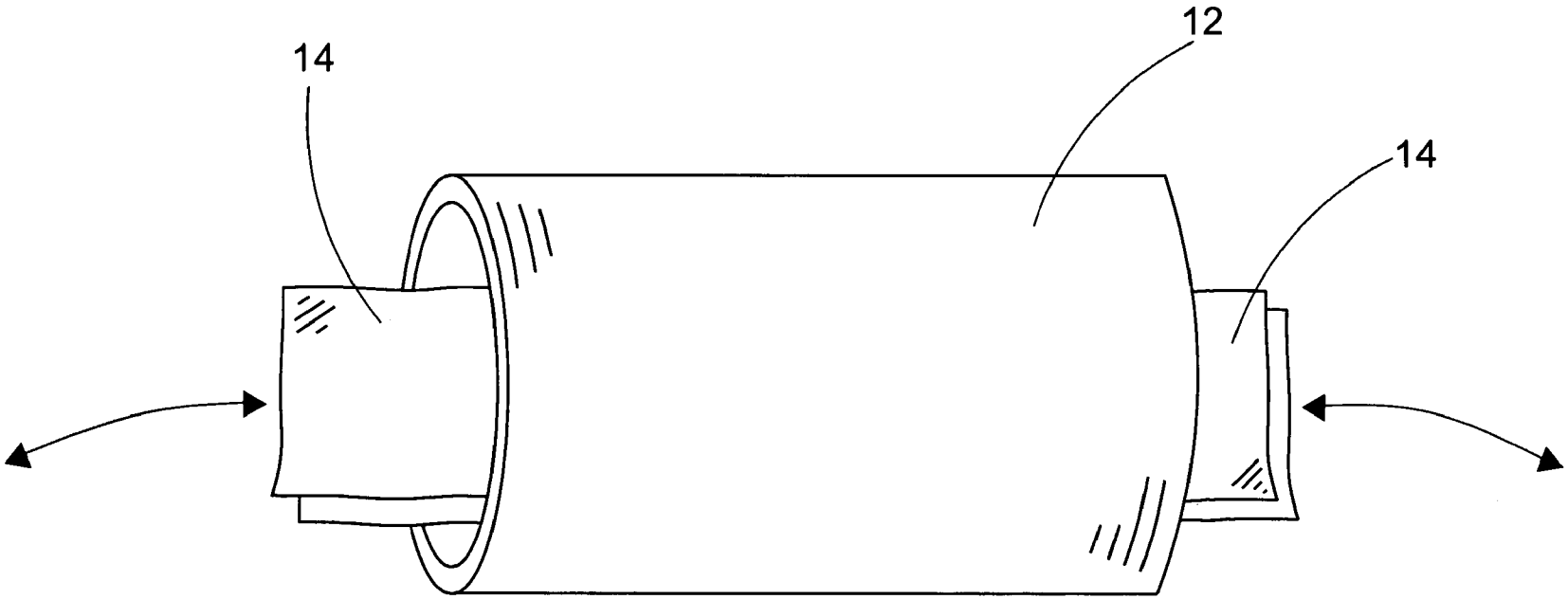
FIG. 7 illustrates a gripping section for holding straps according to one embodiment of the present invention.

FIG. 7 depicts a gripping section (12) with the ductile members (14) stored therein according to one embodiment of the present invention. The gripping section (12) is hollow to allow the user to insert the ductile members (14) for storage. While the handle (10) is not in use, the removable cover (44) can be applied to the attachment means (42) to prevent it from inadvertently sticking to the wrong object (24), the gripping section (12), or the ductile members (14). It is noted that the attachment means (42) may also fold over itself while stored to prevent inadvertent adhesion to other objects. Wherein the attachment means (42) is of the hook and loop type, the attachment means (42) may be stored by attaching the various ductile members (14), either to each other, or folding back on themselves.

In operation, for storage, the user simply pushes the ductile members (14) into the hollow portion of the gripping section (12). For use, the user simply pulls the ductile members (14) out of the gripping section (12), removes the covers (44) from the attachment means (42), and attaches the attachment means (42) to the object (24) (See FIGS. 6A–6E) or to other attachments means attached to the object (24).

Figure 8:
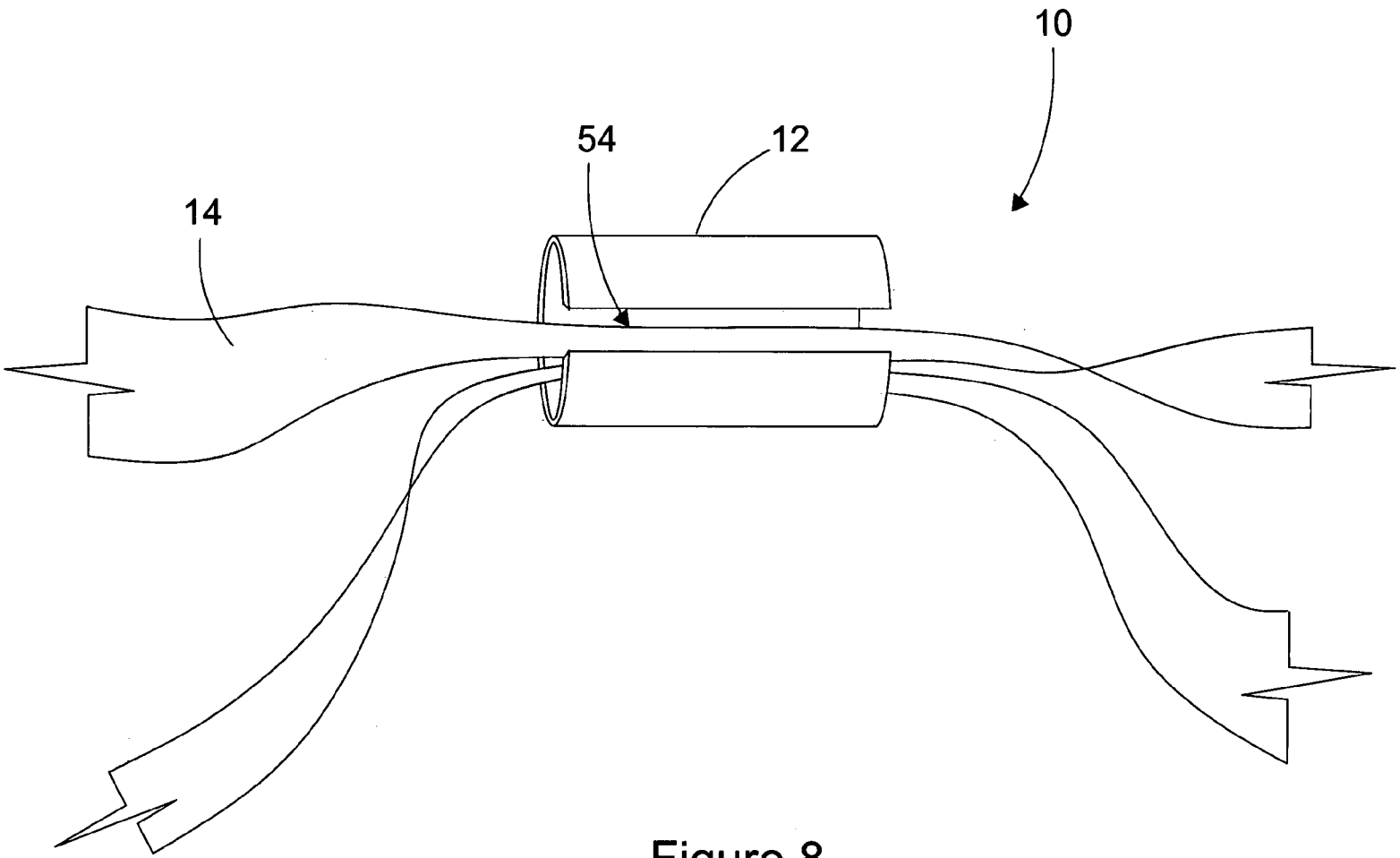
FIG. 8 illustrates a gripping section according to one embodiment of the present invention.

FIG. 8 depicts the gripping section (12) configured to allow removal of the ductile members (14) therefrom according to one embodiment of the present invention. The gripping section (12) includes a slot (54), which extends the full length of the gripping section (12). The slot (54) is wide enough to allow the ductile members (14) to exit from within the gripping section (12). Advantageously, the slot (54) allows a user to remove the ductile members (14) from the gripping section (12) to open a box or bag being held by the handle (10) without detaching the attachment means (42) (see FIG. 5) from the object.

It is understood that the above-described arrangements are only illustrative of the application of the principles of the presently illustrated invention. The present invention may, however, be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the illustrated embodiment(s) show a gripping section (12) of generally round shape, it is envisioned that the gripping section (12) may be any shape, and may be configured to provide the most comfortable grip possible to the users.

Additionally, although the illustrated embodiments show the hole (26) positioned at an upper portion of the gripping section (12), it is envisioned that the hole (26) may be located anywhere on the gripping section (12). Furthermore, it is envisioned that the hole (26) may be replaced with a groove positioned along an edge of the gripping section (12).

Furthermore, although the specification teaches, and the illustrated embodiments show, the use of an independent mechanically operated fastener (30), it is envisioned that the fastener (30) may be replaced with a hook type fastening device located on the gripping section (12). Specifically, a hook capable of gripping the ends of the ductile member (28) may be used such that the user pulls the excess ductile member (14) through the hole (26), or groove, to tighten the first and second hoops (20) and (22) around the object (24), and wraps the ends of the ductile member (28) around the hook. The hook may be configured to pinch the ends of the ductile member (28), or to simply clamp over the ends of the ductile member (28).

Still further, it is envisioned that the ductile members (14) may be removable and replaceable. Specifically, the ductile members (14) may be configured with clips to allow attachment and detachment from the gripping section (12) when the attachment means (42) wears.

Yet further, although the illustrations show that the ductile members (14) pass through open ends of the gripping section (12), it is envisioned that the gripping section (12) include holes passing through a bottom side of the gripping section (12) through which the ductile members (14) pass to attach to the object (24).

Still further yet, while the figures illustrate open ends, through which ductile members extend, as being in substantially parallel planes on opposite sides of the gripping section, being substantially identical in size and shape, and being substantially circular, it is envisioned that the open ends need merely be apertures through which the ductile members may extend. The above mentioned features should not be understood to limit the claims and are merely a preferred embodiment.

Finally, although FIGS. 5–8 do not show the use of a fastener (30) to tighten the ductile members (14), or the hoops created therefrom, it is envisioned that fasteners (30) can be fully incorporated into each design shown therein. It is further envisioned that any embodiment discussed may be configured to incorporate the features of other embodiments.

Thus, while the present invention has been fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A handle to facilitate movement of an object, the handle comprising:

a gripping section having a first open end and a second open end;

a ductile member forming a first hoop extending from the first open end and a second hoop extending from the second open end and configured to wrap around the object, and wherein ends of the ductile member protrude through a first hole in the handle;

spacers protruding from a bottom side of the handle and configured to contact a top side of the object and provide a spacing between the bottom side of the handle and the top side of the object such that a user can grip the handle without contacting the object; and a fastener configured to receive the ends of the ductile member and to allow a user to tighten at least one of the first and second hoops.

2. The handle of claim 1, further comprising a slot in the gripping section extending from the first open end to the second open end.

3. The handle of claim 1, wherein the gripping section is hollow and configured to receive and store the first and second hoops when the handle is not in use.

4. The handle of claim 1, wherein the spacers comprise attachment holes for receiving an additional ductile member, wherein the additional ductile member is configured to wrap around the object in a longitudinal fashion.

5. The handle of claim 4, wherein the additional ductile member comprises:

an attachment means at each end of the additional ductile member configured to attach to the attachment holes.

6. The handle of claim 1, wherein the first and second hoops each comprise a layer of material configured to grip the object.

7. A handle to facilitate movement of an object, the handle comprising:

a gripping section having a first open end and a second open end; and a plurality of ductile members extending from the first open end and from the second open end wherein the ductile members are configured to attach to the object, and wherein portions of a ductile member protrude through a hole in the handle, wherein the handle further comprises spacers protruding from a bottom side of the handle and configured to contact a top side of the object and provide a spacing between the bottom side of the handle and the top side of the object such that a user can grip the gripping section without contacting the object when the handle is tightly attached to the object.

8. The handle of claim 7, further comprising a slot in the gripping section extending from the first open end to the second open end.

9. The handle of claim 7, further comprising a fastener configured to receive the portions of the ductile members and to allow a user to adjust the effective length of the ductile members.

10. The handle of claim 7, wherein the ductile members are configured to attach at end portions, thereby forming hoops.

11. The handle of claim 7, wherein the gripping section is hollow and configured to receive and store plurality of ductile members when the handle is not in use.

12. The handle of claim 7, wherein the spacers comprise attachment holes for receiving an additional ductile member, wherein the additional ductile member is configured to wrap around the object in a longitudinal fashion with respect to the gripping section.

13. The handle or claim 12, wherein the additional ductile member comprises:

an attachment means at each end of the additional ductile member configured to attach to the attachment hole of each spacer.

14. The handle of claim 7, wherein the plurality of ductile members each comprises a layer of material configured to provide grip on the object.

15. A method for using a handle to lift an object without handles comprising the steps of:

providing a gripping section with a first open end and a second open end;

providing a ductile member through the gripping section;

forming, from the ductile member, a first hoop extending from the first open end and a second hoop extending from the second open end;

wrapping the first and second hoops and around the object;

providing a hole in the handle, through which ends of the ductile member protrude;

providing a fastener to receive the ends of the ductile member and to maintain a tight grip on the ends of the ductile member;

providing spacers, which protrude from a bottom side of the handle to contact a top side of the object, and provide a spacing between the bottom side of the handle and the top side of the object such that a user can grip the gripping section without contacting the object when the first and second hoops and are tightened around the object; and pulling the ends of the ductile member to tighten the first and second hoops and around the object to maintain a tight grip around the object.

16. The method of claim 15, further providing a slot in the gripping section extending from the first open end to the second open end.

17. The method of claim 16, further comprising the step of providing attachment holes in the spacers for receiving an additional ductile member, wherein the additional ductile member is configured to wrap around the object in a longitudinal fashion with respect to the handle.

18. The method of claim 17, wherein the additional ductile member comprises:

an attachment means at each end of the additional ductile member for attaching to the attachment hole of each spacer.

19. The method of claim 15, wherein the gripping section is hollow and configured to receive and store the first and second hoops when the handle is not in use.

20. The method of claim 15, further comprising the step of providing a layer of material on the first and second hoops configured to provide grip on the object.

* * * * *

UNITED STATES PATENT AND TRADEMARK OFFICE

CERTIFICATE OF CORRECTION

PATENT NO. : 7,093,324 B2
APPLICATION NO. : 11/027356
DATED : August 22, 2006
INVENTOR(S) : David B. Udy It is certified that error appears in the above-identified patent and that said Letters Patent is hereby corrected as shown below:

On the title page (74)
Attorney, Agent, or Firm: Please change "Mark" W. Starkweather" to read --Michael-- W. Starkweather.

Also, please add the Section entitled (60) "Related U.S. Application Data", and enter the following:

--Continuation-in-part of application No. 10/972,041, filed on October 22, 2004.--

Signed and Sealed this

Twenty-first Day of November, 2006

JON W. DUDAS
*Director of the United States Patent and Trademark Office*